US006416343B1

(12) United States Patent
Chio

(10) Patent No.: US 6,416,343 B1
(45) Date of Patent: Jul. 9, 2002

(54) STRUCTURE OF A CONNECTOR

(76) Inventor: Chuy-Nan Chio, P.O. Box 82-144, Taipei (TW)

( * ) Notice: Subject to any disclaimer, the term of this patent is extended or adjusted under 35 U.S.C. 154(b) by 0 days.

(21) Appl. No.: 09/645,515

(22) Filed: Aug. 25, 2000

(51) Int. Cl.[7] ..... H01R 13/62
(52) U.S. Cl. ..... 439/326
(58) Field of Search ..... 439/326, 325

(56) References Cited

U.S. PATENT DOCUMENTS 5,603,629 A * 2/1997 DeFrasne et al. ..... 439/326
5,669,781 A * 9/1997 Ishida ..... 439/326
6,113,409 A * 9/2000 Park ..... 439/326
6,149,466 A * 11/2000 Bricaud et al. ..... 439/326

* cited by examiner

*Primary Examiner*—Gary F. Paumen
*Assistant Examiner*—James R. Harvey

(74) *Attorney, Agent, or Firm*—A & J

(57) ABSTRACT

A connector includes an elongated cover having a top and two shoulders at two ends of the top thereby forming a cavity between the top and each of the shoulders, each of the shoulders having an inwardly extending flange and a longitudinal hole in which is inserted a pivot pin, a base formed with a plurality of slots in each of which is fitted a spring partially protruded upwardly out of a respective one of the slots, both ends of the base having a longitudinal hole dimensioned to receive the pivot pin so as to pivotally connect the cover with the base, the base being formed with two recesses at two opposite ends thereof configured to receive the flanges of the cover, one of the recesses having a groove thereon, and a torsion spring fitted over an inner end of one of the pivot pin, with an upper end of the torsion spring bearing against a lower side of the top of the cover and a lower end of the torsion spring bearing against the groove of the base thereby forcing the cover to move upwardly to an inclined position with respect to the base, whereby the engagement between a printed circuit board and the connector can be facilitated.

2 Claims, 8 Drawing Sheets

STRUCTURE OF A CONNECTOR

BACKGROUND OF THE INVENTION

1. Field of the Invention

This invention is related to an improvement in the structure of a connector and in particular to one which can be easily connected with a printed circuit board.

2. Description of the Prior Art

Referring to FIGS. 1 and 2, a connector C is welded to a printed circuit board B in advance in order to enable the connecting edge A1 of a cantilever printed circuit board A to be engageable with a socket C1 of the connector C. However, for the purpose of reducing the size of a product, the connector C must be arranged horizontally and then welded on the printed circuit board B, so that the cantilever printed circuit board A can be inserted into the socket C1 of the connector in the horizontal direction thereby reducing the thickness of the product. Nevertheless, such a connector still suffers from the following drawbacks:

1. As the connector C is compact in size and horizontally mounted on the printed circuit board B, there will be a small distance for the operation of inserting the connecting edge A1 of the printed circuit board A into the socket C1 of the connector C thereby causing much difficulty in the engagement operation.
2. The connecting edge A1 of the cantilever printed circuit board A is composed of a number of thin metal plates arranged in order and the socket C1 of the connector C comprises the same number of thin metal spring plates as the thin metal plates, so that the engagement and disengagement of the cantilever printed circuit board A with the connector C will easily cause wear to the thin metal plates of the cantilever printed circuit board A and the fatigue of the thin metal spring plates of the connector C thereby making the connector C difficult to hold the cantilever printed circuit board A firmly and therefore influencing the signal transmission and even causing the cantilever printed circuit board A to fall down from the connector C.

Therefore, it is an object of the present invention to provide an improvement in the structure of a connector which can obviate and mitigate the above-mentioned drawbacks.

SUMMARY OF THE INVENTION

This invention is related to an improvement in the structure of a connector and in particular to one which can be easily connected with a printed circuit board.

It is the primary object of the present invention to provide an improved connector which can facilitate the engagement and disengagement of a cantilever printed circuit board A with a connector.

It is another object of the present invention to provide an improved connector which includes an elongated cover having a top and two shoulders at two ends of the top thereby forming a cavity between the top and each of the shoulders, each of the shoulders having an inwardly extending flange and a longitudinal hole in which is inserted a pivot pin, a base formed with a plurality of slots in each of which is fitted a spring partially protruded upwardly out of a respective one of the slots, both ends of the base having a longitudinal hole dimensioned to receive the pivot pin so as to pivotally connect the cover with the base, the base being formed with two recesses at two opposite ends thereof configured to receive the flanges of the cover, one of the recesses having a groove thereon, and a torsion spring fitted over an inner end of one of the pivot pin, with an upper end of the torsion spring bearing against a lower side of the top of the cover and a lower end of the torsion spring bearing against the groove of the base thereby forcing the cover to move upwardly to an inclined position with respect to the base.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
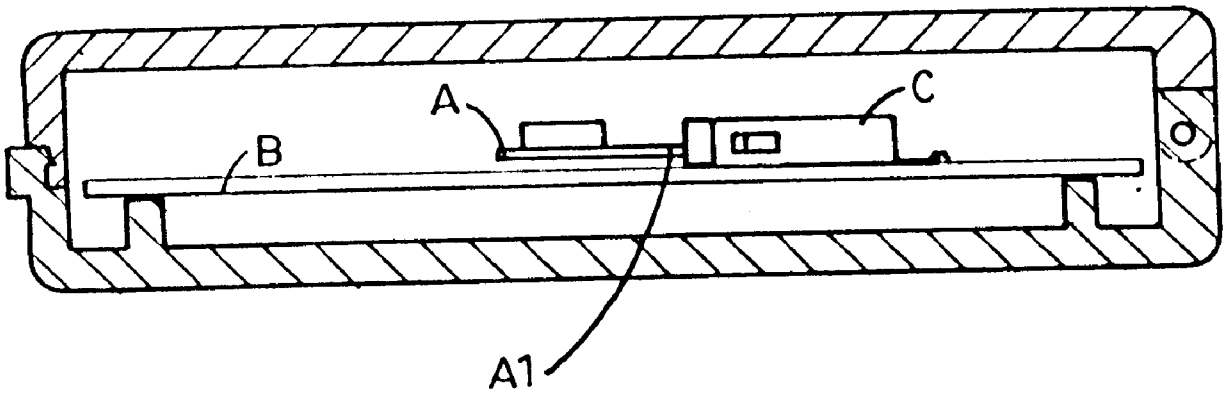
PRIOR ART FIG. 1
FIG. 1 is a sectional view illustrating the engagement between a conventional connector and a printed circuit board.
Figure 2:
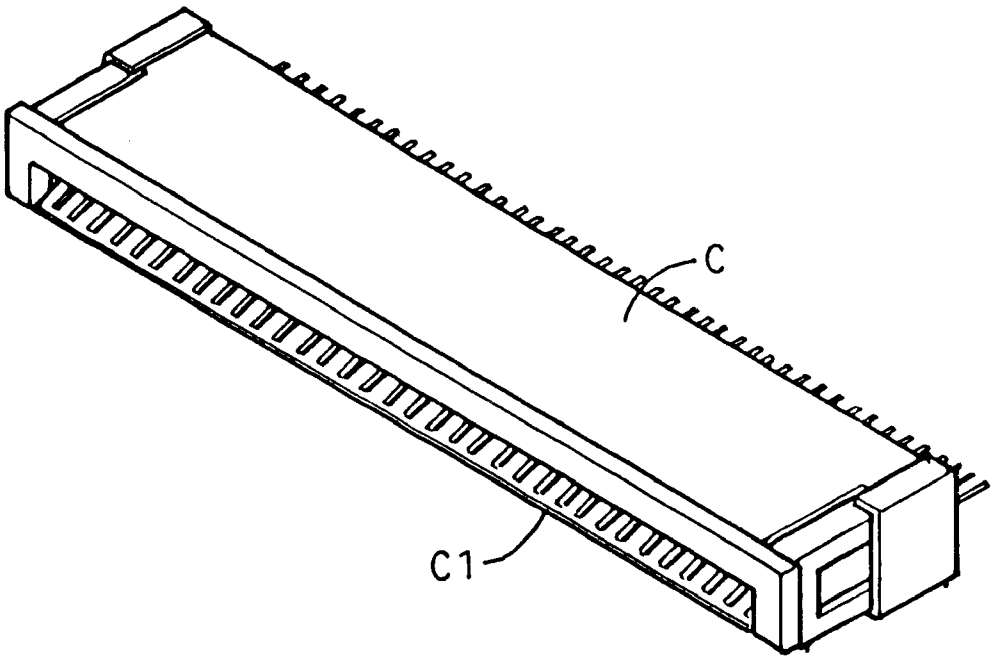
PRIOR ART FIG. 2
FIG. 2 is a perspective view of the conventional connector.
Figure 3:
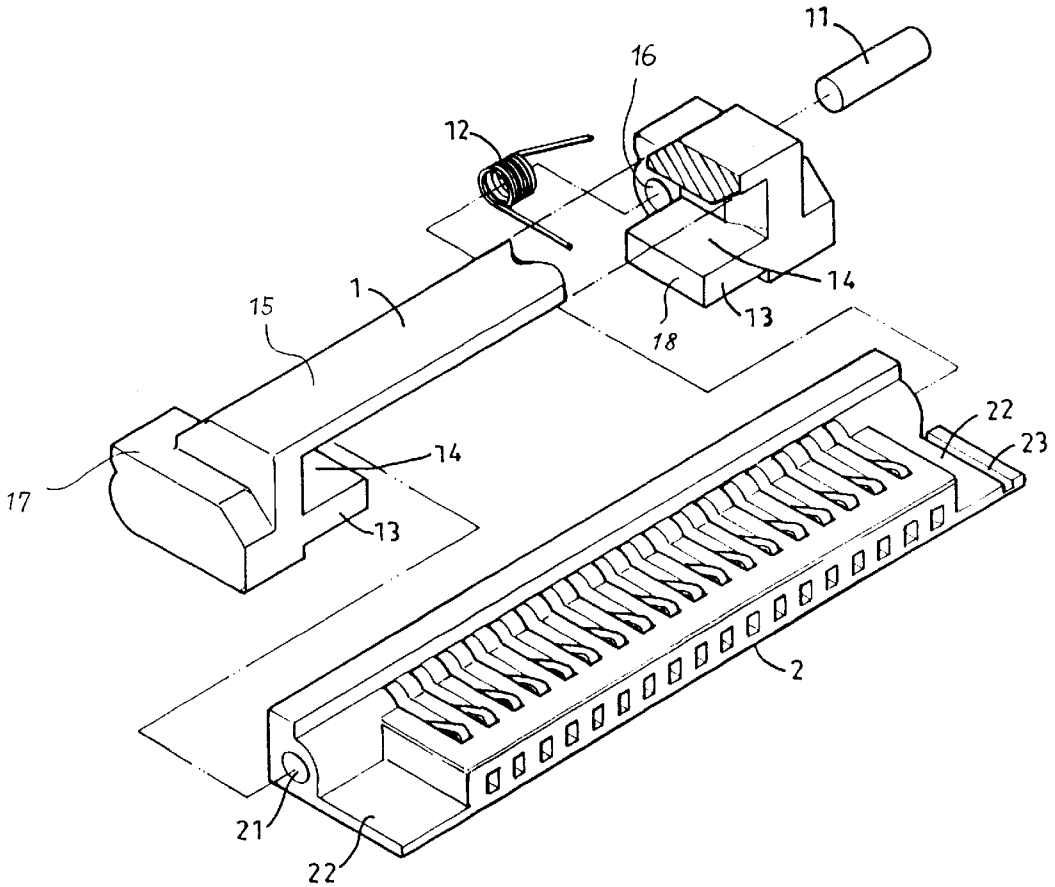
FIG. 3 is an exploded view of an improved connector according to the present invention.
Figure 4:
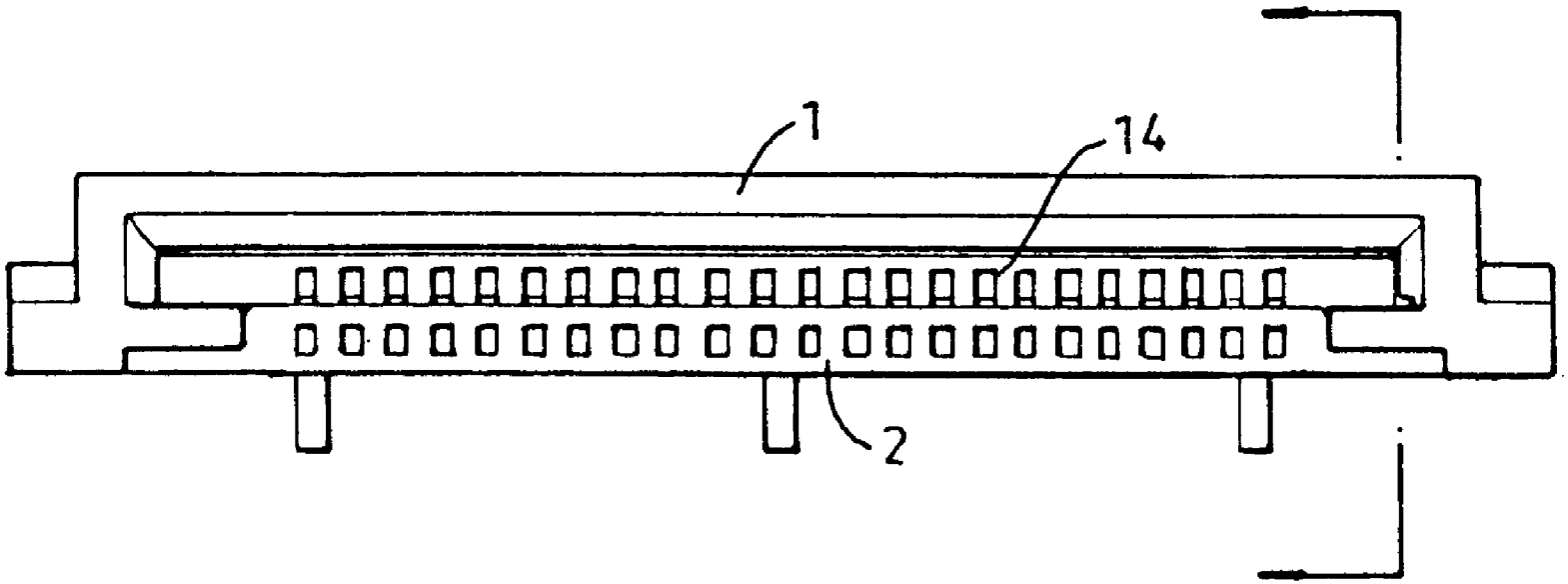
FIG. 4 is a front view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and for modifications in the illustrated device, and such further applications of the principles of the invention as illustrated herein being contemplated as would normally occur to one skilled in the art to which the invention relates.

Referring to FIGS. 3, 4, 5 and 6, the connector according to the present invention generally comprises a cover 1 and a base 2.

The cover 1 is an elongated member having a top 15 and two shoulders 17 at two ends thereof thereby forming a cavity 14 between the top 15 and each of the shoulders 17. Each of the shoulders 17 has an inwardly extending flange 18 and a longitudinal hole 16 in which is inserted a pivot pin 11. A torsion spring 12 is fitted over the inner end of one (or both) of the pivot pins 11, with its upper end bearing against the lower side of the top 15 of the cover 1 and its lower end arranged under the bottom side of the flange 13 of the cover 1.

The base 2 is formed with a plurality of slots in each of which is fitted a spring partially protruded upwardly out of the slot. Both ends of the base 2 have a longitudinal hole 21 adapted to receive the pin 11, so that the cover 11 is pivotally connected with the base 2. The base 2 is formed with two recesses 22 at two opposite ends thereof configured to receive the flanges 13 of the cover 1. One of the recesses 22 has a groove 23 for receiving the lower end of the torsion spring 12.

Figure 5:
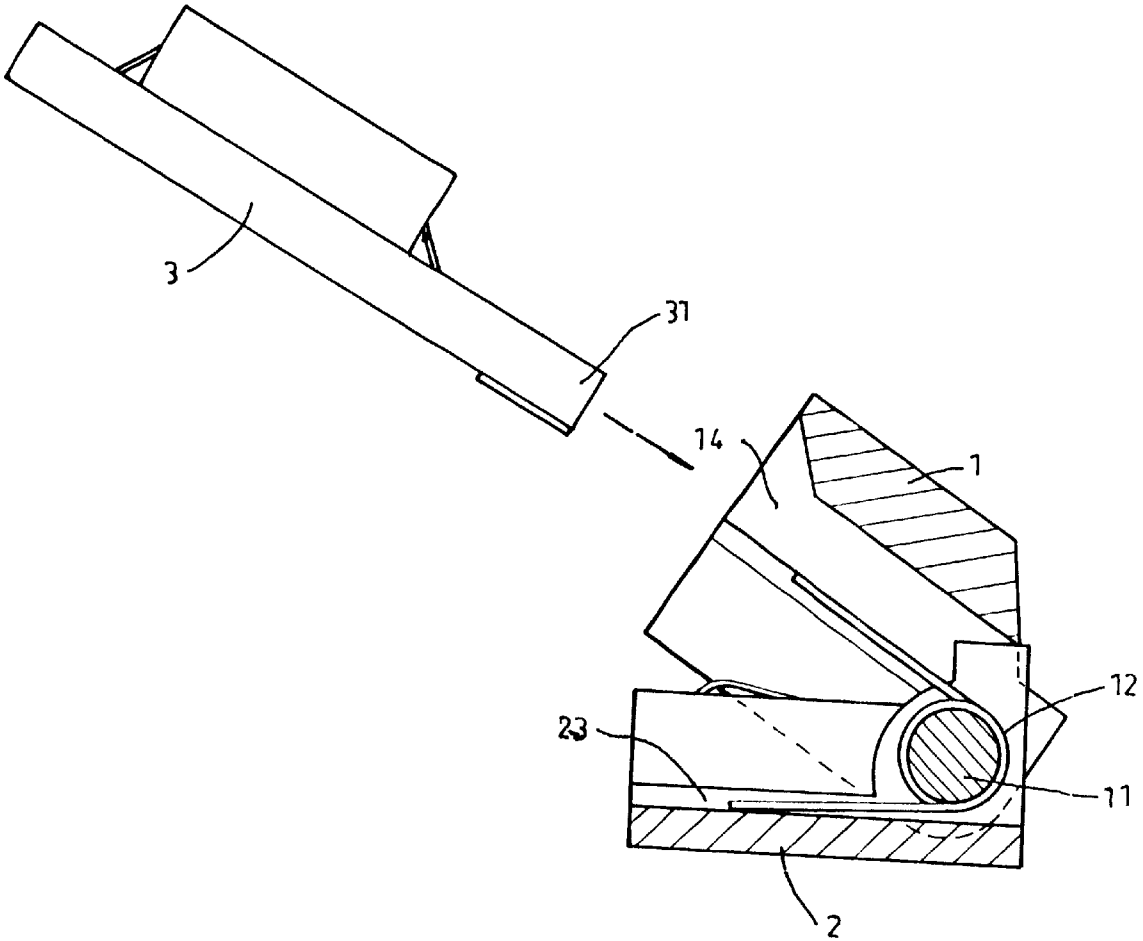
FIG. 5 illustrates how to engage a cantilever printed circuit board with the improved connector according to the present invention.
Figure 6:
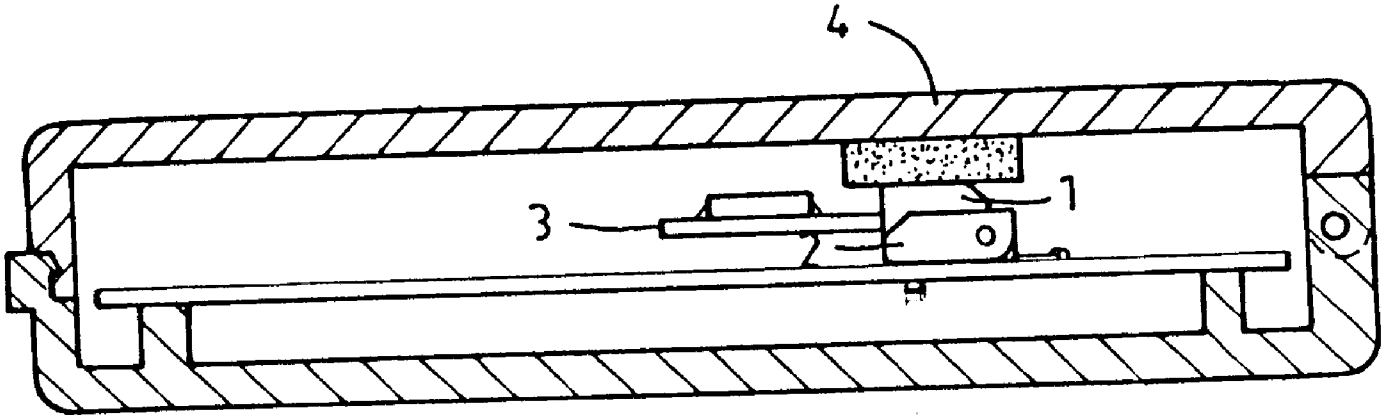
FIG. 6 is a sectional view illustrating how the cover is forced onto the base.

As shown in FIG. 5, the torsion spring 12 is arranged so that its upper end bears against the bottom side of the top 15 of the cover 1 while its lower end against the groove 23 of the recess 22 of the base 2, thereby forcing the cover 1 to move upwardly to an inclined position with respect to the base 2 and therefore facilitating the engagement of the connecting edge 31 of the printed circuit board 3 with the connector 1. When the upper lid 4 of the casing 4 is closed, the cover 1 will be forced to keep the printed circuit board 3 between the cover 1 and the base 2.

Figure 7:
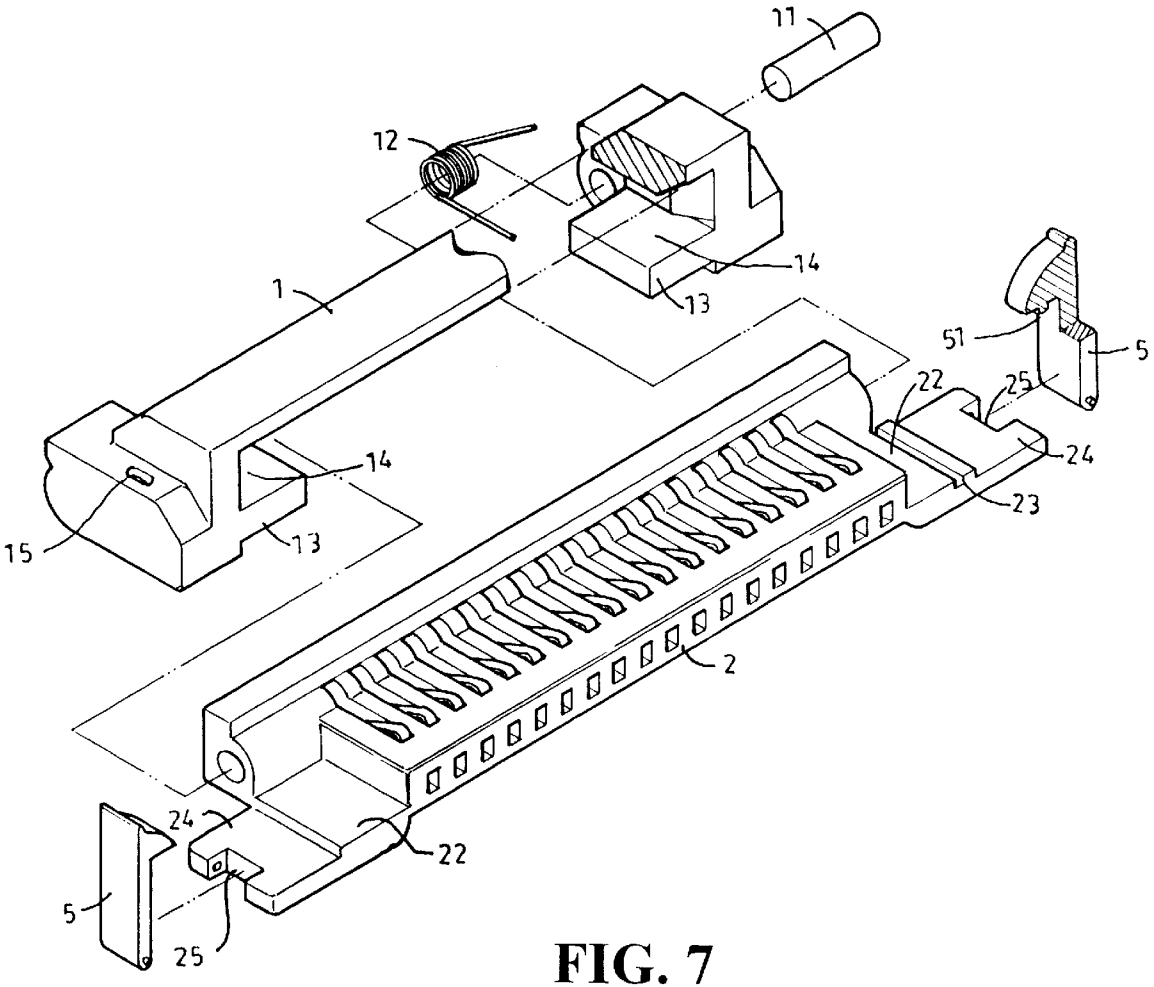
FIG. 7 is an exploded view of a second preferred embodiment of the present invention.
Figure 8:
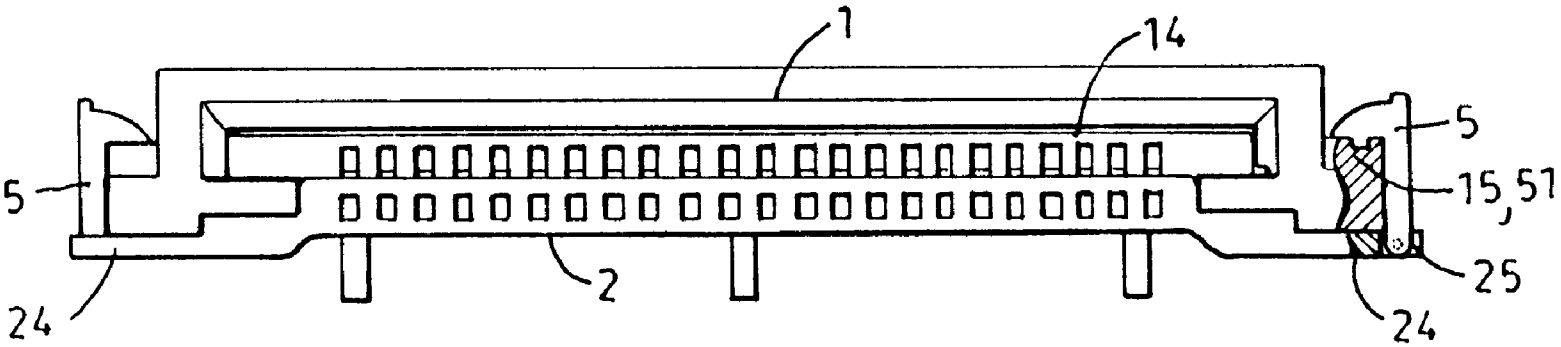
FIG. 8 is a front side of the second preferred embodiment.

FIGS. 7 and 8 illustrate a second preferred embodiment of the present invention. As shown, the base 2 has two lugs 24 extending outwardly from the recesses 22, each of the lugs 24 being formed with a notch 25 which is pivotally connected with an arm 5. The arm 5 has a projection 51 adapted to engage with a hole 15 of the shoulder of the cover 1.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A connector comprising:

an elongated cover having a top and two shoulders at two ends of said top thereby forming a cavity between said top and each of said shoulders, each of said shoulders having an inwardly extending flange and a longitudinal hole into which is inserted a pivot pin;

a base formed with a plurality of slots in each of which is fitted a spring contact partially protruding upwardly out of a respective one of said slots, both ends of said base having a longitudinal hole dimensioned to receive the respective pin so as to pivotally connect said cover with said base, said base being formed with two recesses at two opposite ends thereof configured to receive said flanges of said cover, one of said recesses having a groove thereon; and a torsion spring fitted over an inner end of one of said pivot pins, with an upper end of said torsion spring bearing against a lower side of said top of said cover and a lower end of said torsion spring bearing against said groove of said base thereby forcing said cover to move upwardly to an inclined position with respect to said base and therefore facilitating engagement of a printed circuit board with said connector.

2. The connector as claimed in claim 1, wherein said base has two lugs extending outwardly from said recesses, each of said lugs being formed with a notch which is pivotally connected with an arm, said arm having a projection adapted to engage with a hole of a respective one of said shoulders of said cover.

* * * * *